United States Patent [19]

Olson

[11] Patent Number: 4,877,007

[45] Date of Patent: Oct. 31, 1989

[54] SLING BOW

[76] Inventor: Elwin N. Olson, 361 N. Washington St., P.O. Box 507, Wickenburg, Ariz. 85358

[21] Appl. No.: 228,501

[22] Filed: Aug. 5, 1988

[51] Int. Cl.[4] ..... F41B 7/00

[52] U.S. Cl. ..... 124/22; 124/20 B; 124/20 R

[58] Field of Search ..... 124/22, 20 R, 20 B, 124/21, 20 A, 41 A, 24 R, 25, 86

[56] References Cited

U.S. PATENT DOCUMENTS

| | | | |
|---|---|---|---|
| 2,600,524 | 6/1952 | Fernsel | 124/20 R |
| 2,645,217 | 7/1953 | Fisher | 124/22 X |
| 2,735,417 | 2/1956 | Denekar | 124/29 R |
| 3,057,337 | 10/1962 | Rock et al. | 124/20 A |
| 3,728,996 | 4/1973 | Miller | 124/22 |
| 4,307,699 | 12/1981 | Cuesta | 124/22 |
| 4,407,261 | 10/1983 | Elliott | 124/41 A |
| 4,458,658 | 7/1984 | Blair | 124/20 B X |

FOREIGN PATENT DOCUMENTS

| | | | |
|---|---|---|---|
| 1556026 | 2/1968 | France | 124/20 B |

*Primary Examiner*—Randolph A. Reese
*Assistant Examiner*—Peter M. Cuomo
*Attorney, Agent, or Firm*—Cahill, Sutton & Thomas

[57] ABSTRACT

A sling bow for launching arrows has a handle to which are connected a pair of sling posts to which a twin arm sling is attached. The sling arms are made at least in part of elastic material which can be stretched and then released to propel the arrow between the sling posts. A movable arrow rest connected between the sling arms near the sling posts rises to support the forward end of the arrow when the sling is stretched. When the sling is released and relaxes the arrow rest drops out of the way of the arrow so as not to interfere with its flight. Other features include a pivoted yoke mounting for the sling post to insure uniform tension in the two sling arms and a pivotal mounting for an arm rest extending rearwardly from the handle to permit the bow to be used by both right and left-handed persons.

10 Claims, 2 Drawing Sheets

FIG. 1
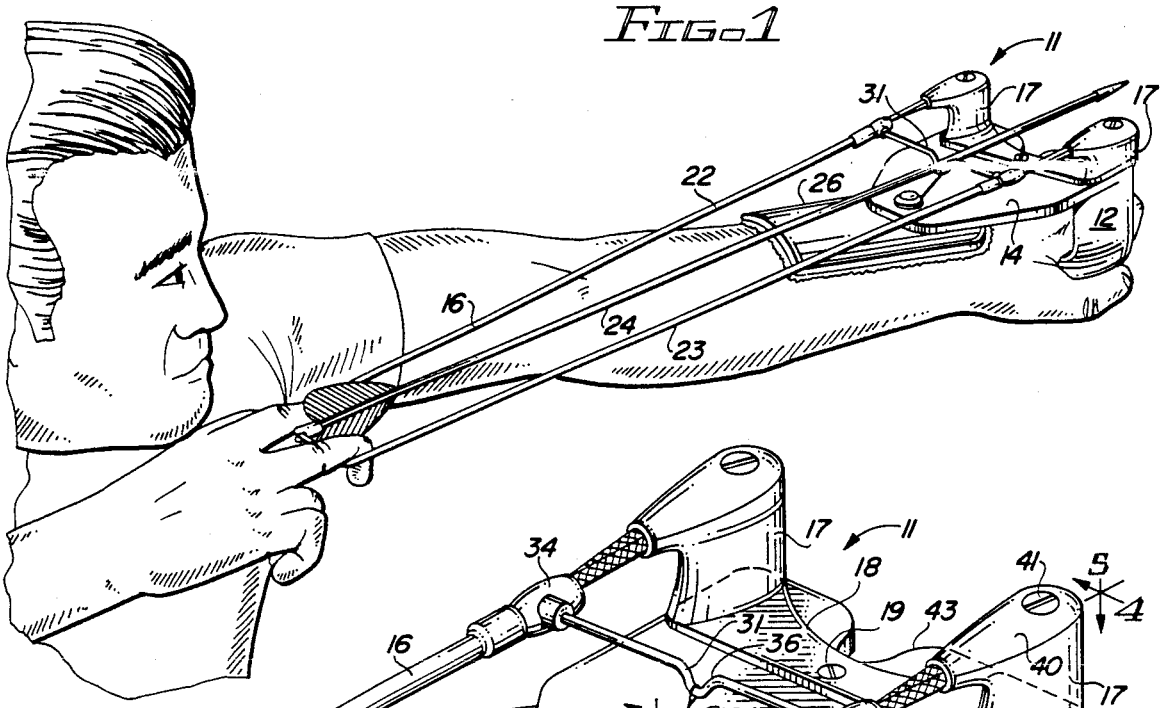
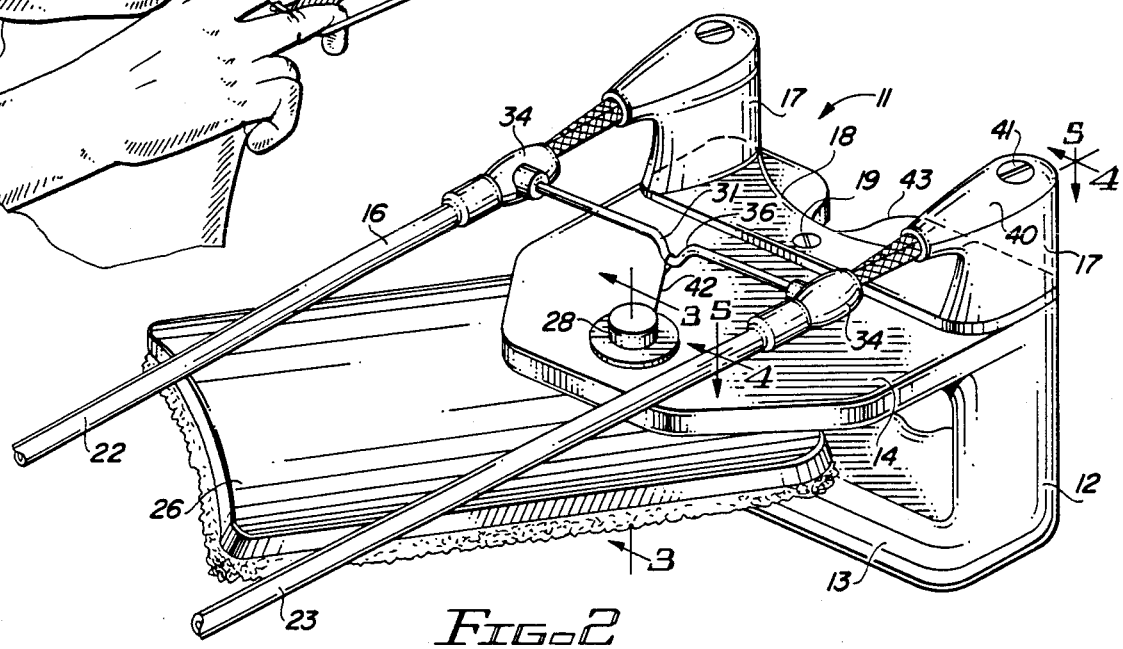
FIG. 2
FIG. 3
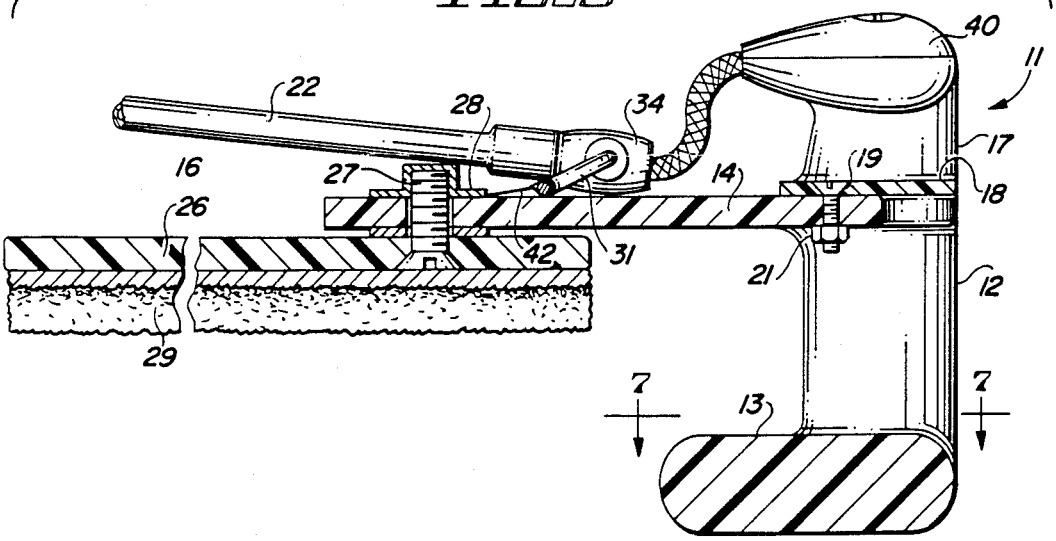

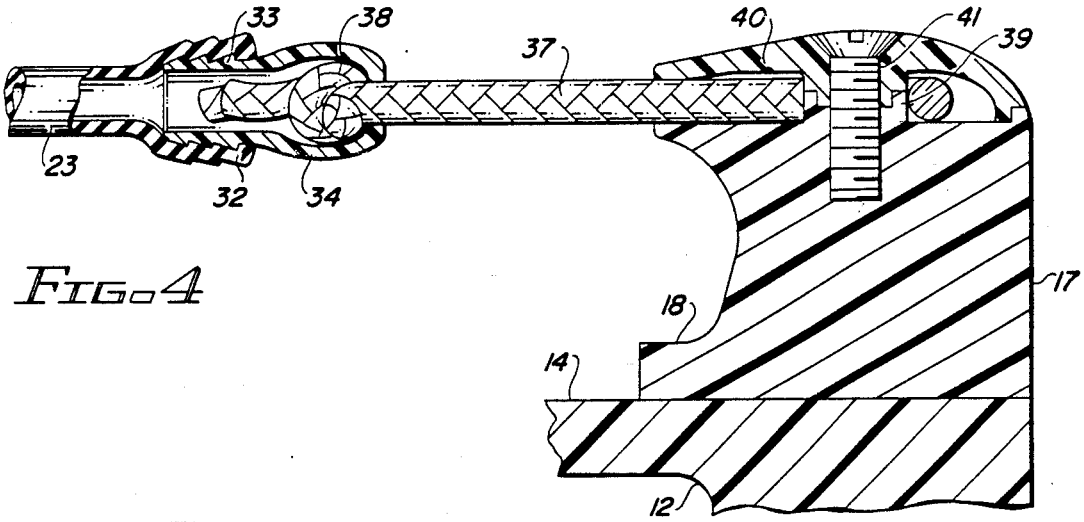
FIG. 4
FIG. 5
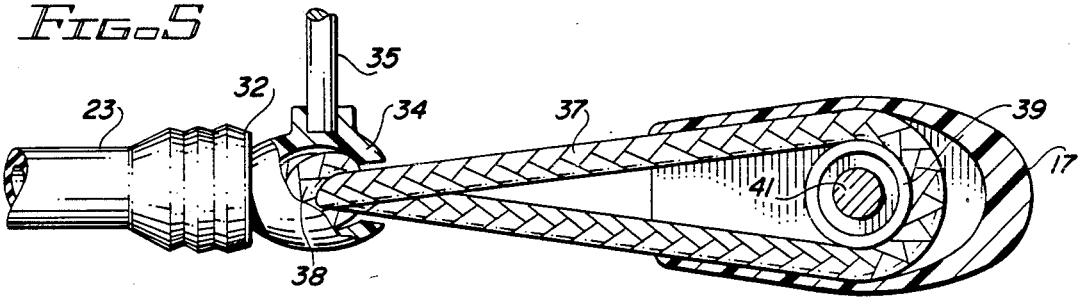
FIG. 6
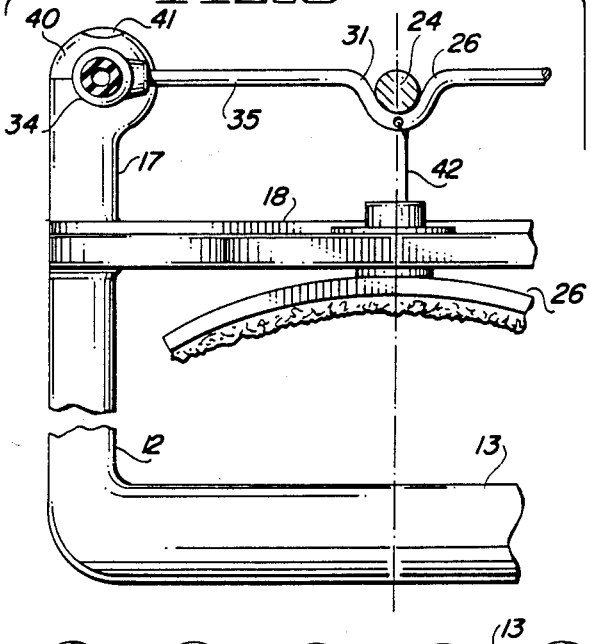
FIG. 8
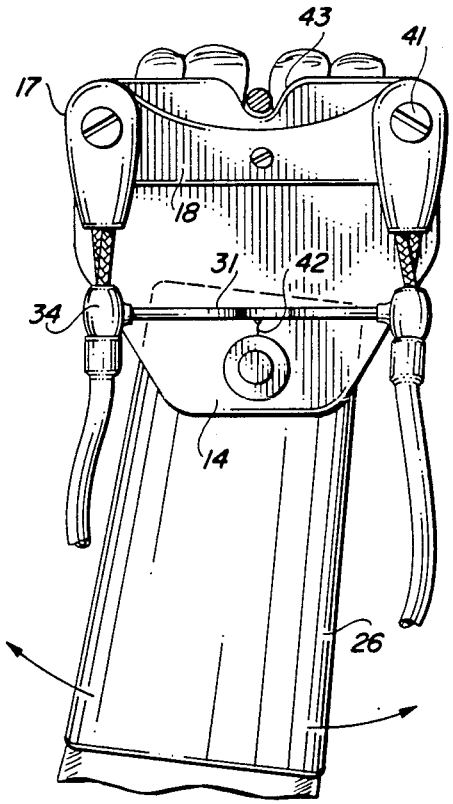
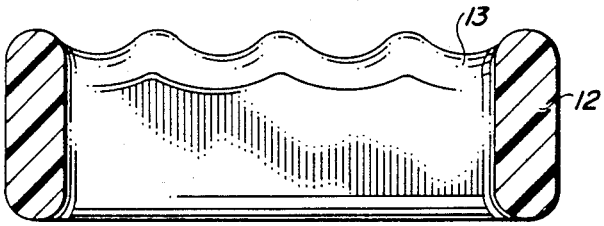
FIG. 7

SLING BOW

TECHNICAL FIELD

This invention is concerned with hand held sling-shot like apparatus for launching arrows. The principal advantage for the sling blow is its small size compared to a conventional arrow bow. BACKGROUND ART Prior inventors have recognized the inherent size advantage of the sling bow. U.S. Pat. No. 2,715,895 granted Aug. 23, 1955 to W. T. Loveless for "SLING-SHOT" discloses a more or less conventional slingshot being used to propel an arrow. C. A. Saunders in his U.S. Pat. No. 3,018,770, granted Jan. 30, 1962 for "SLING BOW" discloses a more sophisticated sling bow embodying an arm rest for steadying the bow when the sling is stretched. Both Loveless and Saunders recognized the desirability of having a rest for the forward region of the arrow when the sling is pulled back. In both cases the arrow rests in these devices are mounted so they can move when struck by the feathers of the arrow; the objective being to reduce the interference to the flight path of the arrow by the arrow rest. In U.S. Pat. No. 3,524,439 granted Aug. 18, 1970 to C. H. Dantzler for "CATAPULT" a hand held slingshot has the arrow rest pivotally mounted and spring biased to a retracted position out of the arrow path.

In addition, U.S. Pat. No. 2,807,254 granted Sept. 24, 1957 to R. A. Stribling for "SLING SHOT" has some features in common with the present invention in that it discloses an arm rest and a sling made from elastic tubing.

In all, the prior art devices leave something to be desired so far as adjustability, reliability and accuracy of shooting are concerned. For example, to convert the Saunders bow from right-hand use to left-hand use requires the bow to be disassembled and reassembled in a different configuration. The Stribling sling shot has no provision for adjusting the arm rest for different hand use.

The arrow rests of the Saunders and Loveless patents move only when struck by the arrow or the sling and, therefore, are likely often to throw the arrow off its desired path. The retractable rest of the Dantzler patent requires a separate spring mechanism to insure retraction of the rest.

DISCLOSURE OF THE INVENTION

In the sling bow of this invention the arrow rest extends between and is supported by the arms of the sling. When the sling is stretched the rest automatically rises to a position where it can support a forward region of an arrow. When the sling is released and relaxes the rest drops out of the way of the arrow so as not to interfere with its flight.

Another feature of the sling bow of this invention is an adjustable arm rest which permits the bow to be quickly and easily converted for different hand use.

A further feature of this invention is a pivotal yoke mounting for the sling posts of the bow which insures that the two arms of the sling will be stretched like amounts when the sling is stretched in preparation for launching an arrow.

Other features, as well, are described in detail hereinafter.

BRIEF DESCRIPTION OF THE DRAWINGS

The invention is described in greater detail by reference to the accompanying drawings wherein:

FIG. 1 is a perspective view illustrating how the sling bow of this invention is used;

FIG. 2 is an enlarged, fragmentary perspective view from above the bow.

FIG. 3 is a vertical sectional view of the bow taken as indicated by line 3—3 in FIG. 2;

FIG. 4 is an enlarged vertical sectional view through one sling post and one sling arm of the bow; this view is taken as indicated by line 4—4 in FIG. 2;

FIG. 5 is an enlarged horizontal sectional view through one sling post taken generally as indicated by line 5—5 in FIG. 2;

FIG. 6 is a fragmentary vertical sectional view looking forwardly at the handle region of the bow;

FIG. 7 is a horizontal sectional view through the handle taken as indicated by line 7—7 in FIG. 3; and FIG. 8 is a fragmentary plan view from above of the bow.

BEST MODE FOR CARRYING OUT THE INVENTION

Referring particularly to FIGS. 1 through 3, the sling bow of this invention is identified generally by reference numeral 11 and is held in one hand of a user by a U-shaped handle 12 having a transverse hand grip 13. Connected to the upper portion of handle 12 is a platform 14 which, if desired, may be formed integrally with handle 12. The handle 12, platform 14 and a number of other components of the sling bow 11 are preferably molded of a strong, impact resistance packed plastic material, such as polystyrene, or polyethylene.

A sling 16 is connected to handle 12 by a pair of sling posts 17 which are connected to handle 12 via a pivotally mounted yoke 18. The pivotal connection for yoke 18 is preferably in the form of a threaded fastener 19 passing loosely through the yoke 18 midway between the sling posts 17 and secured to platform 14 by suitable means, such as a nut 21.

The pivotal mounting of yoke 18 carrying posts 17 assures that the two arms of sling 16, designated 22 and 23, respectively, are tensioned equally when the sling 16 is stretched in preparation for launching of an arrow 24. This equal tensioning of sling arms 22 and 23 greatly improves the accuracy with which the arrow 24 can be launched from the sling bow 11.

The sling bow 11 is steadied in the hand of a user and on the arm of the user by means of an arm rest 26 extending rearwardly from platform 14. As best shown in FIG. 3, the arm rest 26 is coupled to platform 14 by means of a threaded fastener 27. Fastener 27 includes a nut 28 to permit the arm rest 26 to be fictionally connected to platform 14 while permitting it to be pivotally swung through an arc in a generally horizontal plane about fastener 27. This adjustment of arm rest 26 with respect to the handle 12 of the sling bow 11 permits the bow to be quickly and readily adjusted from right-hand use as depicted in FIGS. 1 and 2 to left-hand use in which the rest 26 would be swung about fastener 27 to a position just to the right of the center line of the sling bow 11.

The arm rest 26 may also be formed of molded plastic material and may have a cushion material 29, such a pile fabric, covering its lower surface for contacting the forearm of the user.

The sling bow 11 also preferably includes an arrow rest 31 extending between arms 22 and 23 of sling 16 near sling posts 17 and in a position to support a forward region of arrow 24 when the sling 16 is stretched in preparation for launching the arrow (see FIG. 1).

The preferred construction of sling 16 and the mounting arrangement for arrow rest 31 are illustrated in greater detail in FIGS. 4 through 6. At least a portion of each arm 22 and 23 of sling 16 must be made of elastic material, such as a tubular rubber material. The forward ends 32 of the tubular rubber portions of sling arms 22 and 23 are forced over ribbed protrusions 33 on molded plastic fittings 34 (see FIGS. 4 and 5). If desired, a suitable adhesive can be applied between the protrusions 33 and the tube ends 32 to securely affix the tubes to the fittings 34. Fittings 34 receive and hold the ends of a wire member 35 which has a V notch 36 midway between its ends to receive the shaft of the arrow 24.

The foremost ends of arms 22 and 23 of sling 16 are preferably in the form of a flexible, but inelastic connection between fittings 34 and sling posts 17. This connection preferably comprises, for each leg 22 and 23, a loop of woven twine 37 having a knotted end 38 held within a cavity within fitting 34. The forward end portion of twine loop 37 is positioned over a cylindrical protuberance 39 within sling post 17 and held in place by a sling post cap 40 fastened to post 17 by suitable means, such as a screw 41. The flexible connection provided by flexible twine loops 37 permits forward regions of sling arms 22 and 23, specifically fittings 34 which carry arrow rest 31, to drop down against the upper surface of platform 14 when the sling 16 is released to launch an arrow 24. This condition is illustrated in FIG. 3. Thus, the arrow rest 31 immediately moves out of the path of the arrow 24 as soon as the arrow is launched, thereby precluding the rest 31 from interfering with the flight of the arrow.

When the sling 16 is again stretched in preparation for launching an arrow 24 the flexible twine loops 37 permit fittings 34 and arrow rest 31 to rise above platform 14 in position to support the forward portion of the arrow. Arrow rest 31 is stabilized in this upper position by means of a restraint 42. Restraint 42 may take the form of a flexible wire having one end attached to the notch region 36 of support 31 and its other end affixed beneath fastener nut 28 on platform 14.

Loading of an arrow into sling bow 11 is facilitated by providing in the forward edge of platform 14 a guide notch 43 (see FIG. 8). When the user grips hand grip 13 of handle 12 the space between the two middle fingers of the hand is exposed beneath notch 43. This permits an arrow to be inserted in that space between those fingers in an upright position and held until the other hand is used to knock the end of the arrow in sling 16. As the arrow is pulled rearwardly with the sling 16 the fingers on the hand grip release the arrow and permit it be drawn rearwardly to its launch position.

From the foregoing it should be apparent that this invention provides an improved sling bow possessing a number of features contributing to its usefulness and accuracy and reliability.

What is claimed is:

1. A sling bow comprising a handle, a pair of spaced sling posts connected to said handle, a flexible sling having its opposite ends connected respectively to said posts and having arms extending rearwardly from the posts to receive the nock of an arrow, the arms of said sling being made at least in part of elastic material so that they can be stretched and released to propel an arrow from the bow between the posts, and an arrow rest extending between the arms of said sling, said arrow rest being secured to and supported solely by flexible regions of said sling arms in spaced relation to and moveable with respect to said posts, the flexible arms of said sling providing the sole support for said arrow rest whereby the rest drops out of the path of the arrow when the sling is released to launch an arrow.

2. The sling bow of claim 1 further comprising a platform member extending rearwardly from said posts, and a flexible restraint connecting said arrow rest to said platform.

3. The sling bow of claim 2 further comprising an arm rest connected to said platform, and a pivotal connection between said arm rest and said platform whereby said arm rest can be moved in relation to the handle of the bow to accommodate use by either a right-handed person or a left-handed person.

4. The sling bow of claim 3 further characterized in that said pivotal connection also connects said restraint to said platform member.

5. The sling bow of claim 1 further comprising a yoke member connecting said sling posts, and means providing a pivotal connection between the yoke member and the handle midway between the sling posts.

6. A sling bow comprising a handle having a generally horizontal disposed hand grip, a pair of spaced, upwardly extending sling posts connected to said handle, a flexible sling having its opposite ends connected respectively to said posts and having arms extending rearwardly from the posts to receive the nock of an arrow, at least a portion of each arm of the sling being made of elastic material, and an arrow rest extending between the arms of said sling, said arrow rest being secured to and supported solely by flexible regions of said sling arms in spaced relation to and moveable with respect to said posts, the flexible arms of said sling providing the sole support for said arrow rest whereby the rest drops out of the path of the arrow when the sling is released to propel an arrow.

7. The sling bow of claim 6 further comprising a flexible restraint for limiting upward movement of said arrow rest.

8. The sling bow of claim 6 further characterized in that those portions of the arms of the sling between said arrow rest and said posts are made from a flexible and substantially inelastic material.

9. The sling bow of claim 6 further comprising an arm rest extending rearwardly from said handle, and means for pivotally connecting said arm rest to said handle for movement about a generally upright axis.

10. The sling bow of claim 6 further comprising a yoke member connecting said sling post and means providing a pivotal connection between the yoke member and the handle midway between the sling posts.

* * * * *